US005330052A

United States Patent [19]

Van Hest

[11] Patent Number: 5,330,052

[45] Date of Patent: Jul. 19, 1994

[54] PACKED ELECTRIC LAMPS

[75] Inventor: Wilhelmus J. J. Van Hest, Eindhoven, Netherlands

[73] Assignee: U.S. Philips Corporation, New York, N.Y.

[21] Appl. No.: 70,147

[22] Filed: May 28, 1993

[30] Foreign Application Priority Data

Jul. 24, 1992 [NL] Netherlands ..... 9201333
Aug. 13, 1992 [EP] European Pat. Off. ..... 92202495.5

[51] Int. Cl.[5] ..... B65D 85/42
[52] U.S. Cl. ..... 206/419
[58] Field of Search ..... 206/418, 419, 420, 421, 206/422

[56] References Cited

U.S. PATENT DOCUMENTS 359,435 3/1887 Elliott .
2,964,227 12/1960 Goldsholl .
4,951,813 8/1990 Sauter ..... 206/420

FOREIGN PATENT DOCUMENTS 969457 6/1958 Fed. Rep. of Germany ..... 206/418
544587 2/1977 U.S.S.R. ..... 206/418
241097 10/1925 United Kingdom ..... 206/418
952295 3/1964 United Kingdom ..... 206/418
1093954 12/1967 United Kingdom ..... 206/418

*Primary Examiner*—William I. Price
*Attorney, Agent, or Firm*—Paul R. Miller

[57] ABSTRACT

The packed electric lamps have a box (1) provided with a base (2) having a base wall (7) and side walls (3, 4, 5, 6) connected thereto. First seats (31) and corresponding second seats (41) are present in the base (2) at a first side wall (3) and a second (4) side wall, in which seats cushion-shaped cartons (50) with electric lamps (20) are held. The packed electric lamps have a comparatively small volume, but the packaging also protects comparatively vulnerable lamps against damage.

10 Claims, 5 Drawing Sheets

PACKED ELECTRIC LAMPS

Figure 1:
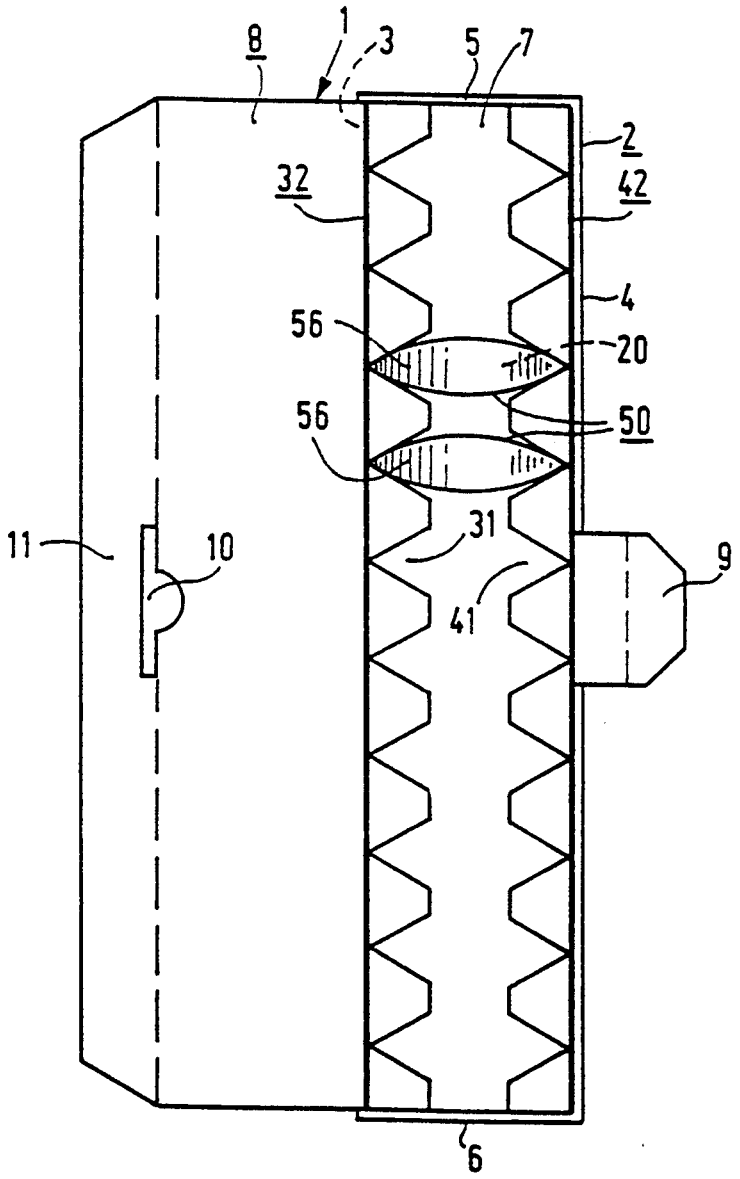

The invention relates to packed electric lamps comprising a box provided with a base having a base wall and side walls connected thereto and to one another, and provided with a lid, first seats and in line therewith second seats being present in the base at a first wall and a second wall, respectively, of the walls, and electric lamps enclosed each at a distance from others in a respective first and a respective second seat.

BACKGROUND OF THE INVENTION

Such packed electric lamps are known from U.S. Pat. No. 4,951,813.

These lamps may form part of a Christmas tree set. In such a set, lamps are electrically connected in series so as to be connected to the mains. Accordingly, only a fraction of the mains voltage is across each of the lamps during operation. The lamps for this reason have a comparatively small incandescent body made of comparatively thick wire, and are also robust in other respects.

In the known box, the first and the second seats are present at adjoining walls of the base. They keep the walls separate from the lamps.

It was found that less robust lamps such as, for example, incandescent lamps with incandescent body sections positioned in one or two planes, for example, in a tungsten frame, are subject to too great risks of damage during transport when packed in this manner. Such lamps are used, for example, for studio, theatre, or disco lighting or for scene illumination during video takes. Because of the required high colour temperature of the light to be generated by these lamps, they are highly loaded and a tungsten frame must often be used. When the lamps are flashed at the end of their manufacturing process, the tungsten of the frame and of the incandescent body crystallizes, so that the latter becomes vulnerable to shocks.

However, other types of lamps such as, for example, high-pressure gas discharge lamps, for example lamps in which a discharge vessel is arranged in an outer bulb, may also have such a vulnerability to shocks, for example, because the outer bulb breaks when the suspension assembly of the discharge vessel hits against this bulb with force.

The lamps described are wrapped in an instruction leaflet and then in a sheet of synthetic resin foam and inserted in a carton. A few of these cartons are put in an outer container together between buffers which surround them. The volume of the packed lamp as a result is great, as are the packaging and shipment costs. The diversity of materials used: synthetic resin and cellulose fiber material, furthermore, is disadvantageous for the recycling possibilities of the packaging.

SUMMARY OF THE INVENTION

It is an object of the invention to provide packed electric lamps of the kind described in the opening paragraph in which the volume per packed lamp is comparatively small while the packaging nevertheless offers the lamps a satisfactory protection, even if they are vulnerable to shocks.

According to the invention, this object is achieved in that the lamps are enclosed in cushion-shaped cartons having a longitudinal direction, the first and the second seats are present at a first and a second side wall, which walls face one another and run substantially parallel to the longitudinal direction of the cushion-shaped cartons, which cartons are each accommodated in a first seat and in a second seat in line therewith.

Cushion-shaped cartons have long been known, for example, from U.S. Pat. No. 359,453 (1885) and U.S. Pat. No. 2,964,227. The cartons of the present invention are made from a flat sleeve having a longitudinal direction and first folding lines in the longitudinal direction in that a tag at an end portion of this sleeve is folded inwards about a curved and/or bent second folding line transverse to the longitudinal direction. The tag then gives the flat sleeve a third dimension with mutually opposing, externally convex and/or bent wider walls and an externally concave, curved and/or bent end face. The tag may close off the sleeve wholly or partly at the said end portion, on its own or together with an opposing tag at the same end portion. A second end portion of the sleeve has one or several similar tags. The mutually opposing wider walls may be directly interconnected along the first folding lines or via a comparatively narrow intermediate strip. In the case of a curved second folding line, the cushion-shaped carton is then barrel-shaped seen in its longitudinal direction.

The seats may be integral with the relevant side walls of the carton, for example, in that incisions are made in the relevant walls so as to make profiled tongues which are bent from these walls inwards to the base of the carton, in which case the tongue profile encloses the cushion-shaped cartons.

An alternative is that the relevant side walls each have an anterior wall from which such tongues have been cut out.

In a favourable embodiment, the anterior walls each have a fold which is bent about parallel folding lines and in which windows have been cut out so as to form seats. It is convenient for packaging of the lamps when the anterior walls in a modification of this embodiment are interconnected along connecting folding lines by means of a connection strip. It is favourable in this case when the connection strip extends along the base wall.

In an alternative embodiment, a partition wall is present in the base between the first and the second side wall, in which partition wall second seats facing toward the first side wall and first seats facing toward the second side wall are present. This embodiment has the advantage that there is a wider range of options for the relative dimensions of the box, for example, for making the stability of the box less dependent on its position. If so desired, the box may then approximate the cubic shape more closely.

It is favourable when the partition wall is double-walled, in particular when it is also made of two parts. Each part of a two-part partition wall may be connected to a respective anterior wall via a connection strip.

The lid may be separate from the base, but alternatively it may be integral therewith. The lid is, for example, a flap at, for example, the first side wall. A favourable embodiment is one in which a fixation tongue is present at the opposite side wall cooperating with the lid, fixing the lid in closed position. An anterior wall of this opposite side wall may have a tag which is bent inwards. The tag then forms a guide for the lid when the box is being closed.

It was found that the packaging offers the lamps a good protection against damage. The packaging: the box with its base and its lid, the cushion-shaped cartons and, if present, the anterior walls may be made of an identical kind of material such as cellulose fiber material such as cardboard, for example, duplex or triplex cardboard, corrugated cardboard, mini-corrugated cardboard, etc. The lamp in the cushion-shaped carton may be enveloped in a bag to protect it against contact of bare hands with, for example, quartz glass parts. It is favourable in that case to use a similar material, for example, paper. The bag may be printed with instructions for the user of the lamp. It is favourable when the bag has an excess length compared with the lamp and this excess length is folded back along the lamp. The bag may then provide an extra protection as a padding in the cushion-shaped carton. A decrease in volume of approximately 50% can be realised with the packed electric lamps according to the invention compared with conventionally packed lamps. The box may serve as a magazine from which a lamp is taken as required. The remaining lamps keep their protection in the now partly filled box thanks to the seats.

BRIEF DESCRIPTION OF THE DRAWING FIGURES

Figure 2A:
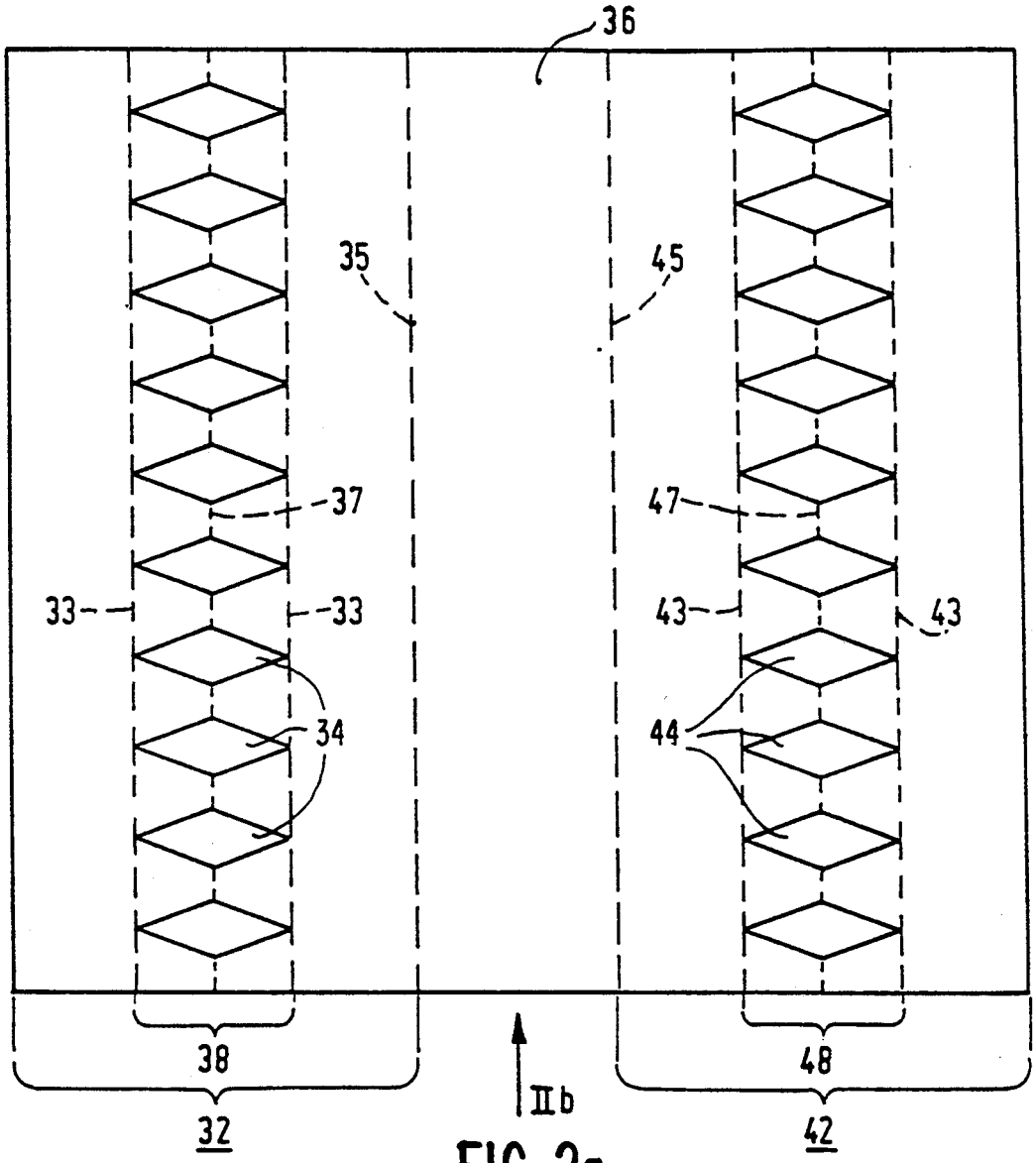
Figure 2B:
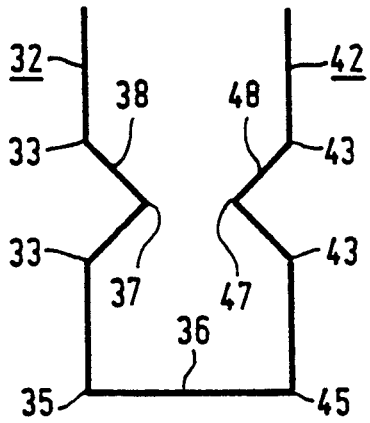

Embodiments of the packed electric lamps according to the invention are shown in the drawing, in which FIG. 1 is a front elevation of the opened box with the packed electric lamps;

FIG. 2*a* shows the blank of interconnected anterior walls, which is folded into shape in FIG. 2*b* and is viewed on the line II in FIG. 2*a;*

Figure 3:
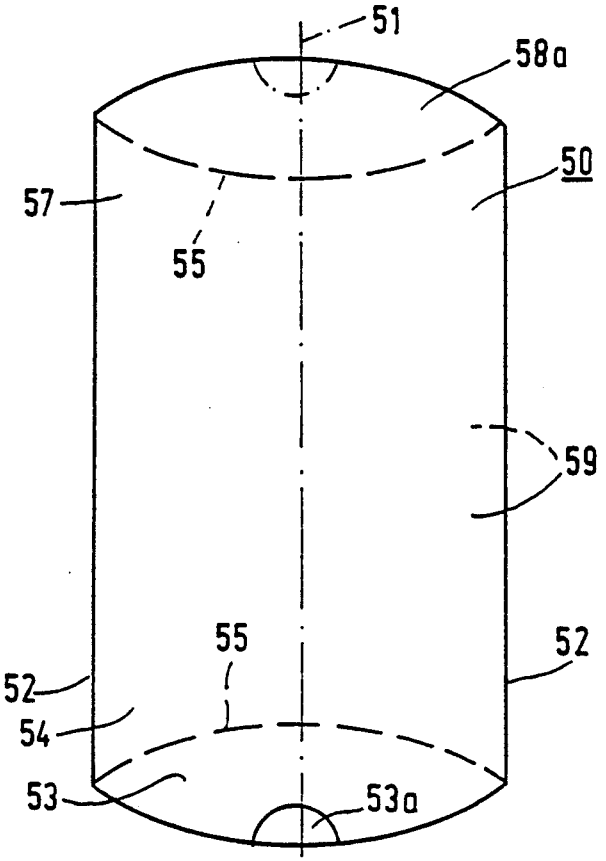
Figure 4B:
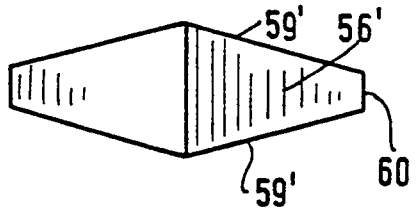
Figure 4A:
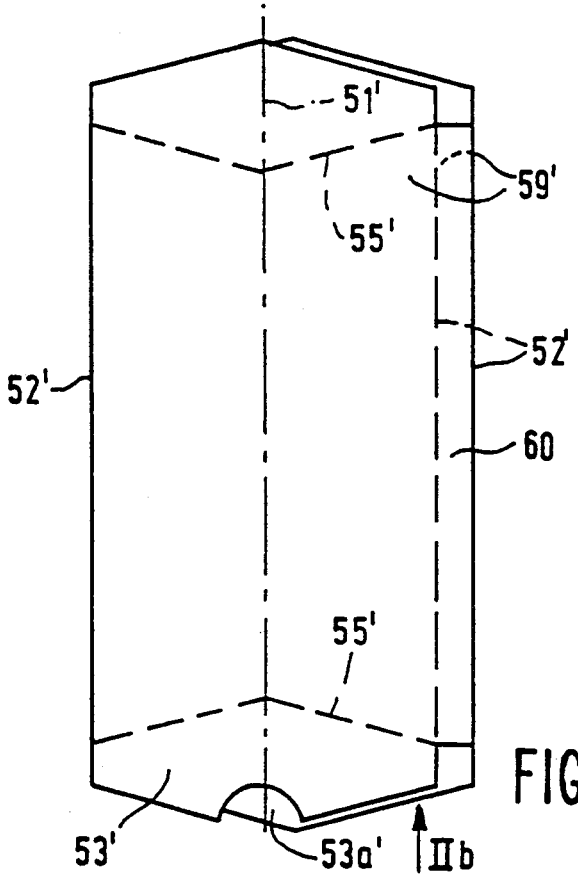

FIG. 3 is a plan view of the flat sleeve of the cushion-shaped carton;

FIG. 4*a* is a modification of FIG. 3;

FIG. 4*b* is the front elevation of the cushion-shaped carton formed from FIG. 4*a;*

Figure 5A:
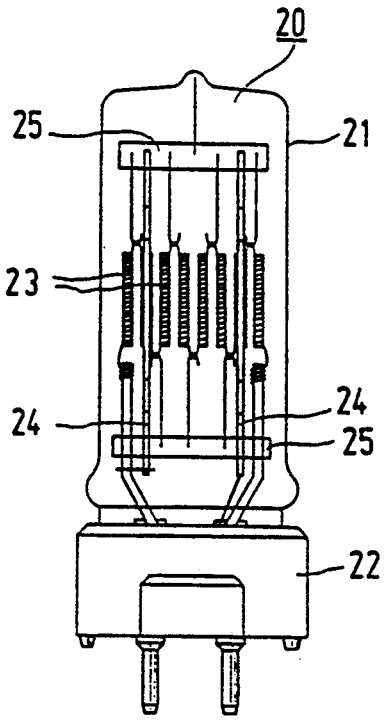
Figure 5B:
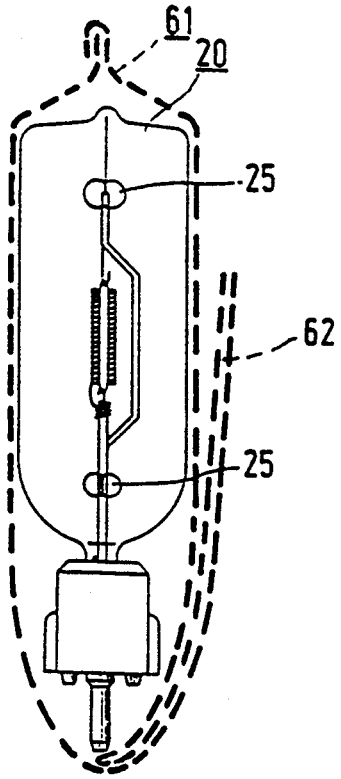
Figure 5C:
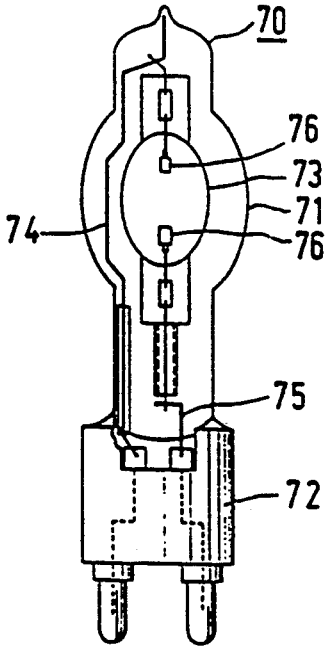
Figure 6:
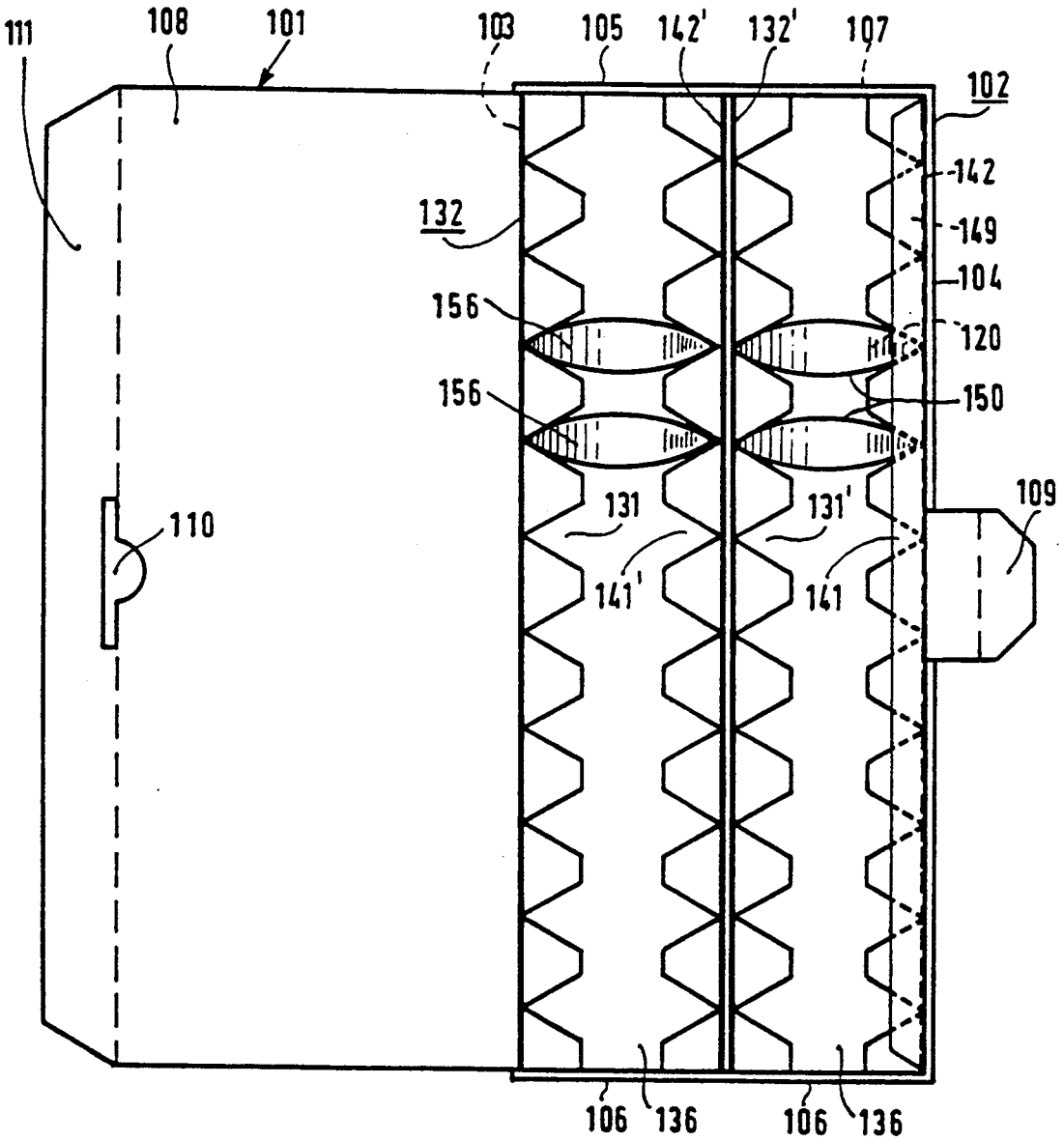

FIGS. 5*a* and 5*b* are a front and a side elevation, respectively, of the electric lamp of FIG. 1, with FIG. 5*c* showing an alternative version; and FIG. 6 shows a modification of FIG. 1.

DESCRIPTION OF THE INVENTION

In FIG. 1, the box 1 has a base 2 with a base wall 7 and side walls 3, 4, 5, 6 connected thereto and to one another, and a lid 8. First seats 31 and second seats 41 in line with the first seats are present in the base 2 at a first 3 and a second 4 of the walls. Electric lamps 20 are each enclosed in a respective first seat 31 and a respective second seat 41, each at a distance from the other lamps.

The lamps 20 are enclosed in cushion-shaped cartons 50 with a longitudinal direction 51 (FIG. 3). The first seats 31 and the second seats 41 are present at a first side wall 3 and a second side wall 4 which are in mutual opposition and which run substantially parallel to the longitudinal direction 51 of the cushion-shaped cartons 50. The cushion-shaped cartons 50 are each held in a first seat 31 and a second seat 41, in line with the first.

The first side wall 3 and the second side wall 4 have anterior walls 32, 42 in which the seats 31, 41 are present. The anterior walls 32, 42 have respective folds 38, 48 bent about parallel folding lines 33, 43 in which windows 34, 44 are provided, serving as seats 31, 41 (see FIG. 2*a*). Alternatively, the windows may extend not up to, but only up to a certain distance away from the respective folding lines 33, 43.

In FIGS. 2*a*, *b*, the anterior walls 32, 42 are interconnected along connecting folding lines 35, 45 by a connection strip 36. The connection strip 36 may extend along the base wall 7 (FIG. 1). In the center of each fold 38, 48, in the embodiment shown, there is a respective folding line 37, 47 which gives the fold an extra kink and thus plane flanks.

The lid 8 (FIG. 1) is a flap at a side wall 3. The opposite side wall 4 has a fixation tongue 9 which cooperates with the lid 8. The fixation tongue 9 may enter a recess 10 of a closing flap 11 at the lid 8.

In FIG. 3, the flat sleeve 50 of the cushion-shaped carton of FIG. 1 has a longitudinal direction 51 and first folding lines 52 in the longitudinal direction. When the tag 53 at an end portion 54 of this sleeve is folded inwardly about the curved second folding line 55 transverse to the longitudinal direction 51, the tag gives the flat sleeve a third dimension with mutually opposing externally convex wider walls 59 and an externally concave, curved end face (56, FIG. 1), i.e. a cushion shape. The tag may fully close off the sleeve at the end portion, alone or together with an opposing tag 53*a* at that same end portion, in the Figure in overlapping manner. The tag 53 may be folded inwardly first, before tag 53*a* is folded inwardly. Tag 53 has a finger hole through which the tag 53*a* is visible so that this tag can be easily brought into the open position. A second end portion 57 of the sleeve has one or several similar tags 58*a*.

In FIG. 4, the mutually opposing wider walls 59' are not directly interconnected along the first folding lines 52', but via a comparatively narrow intermediate strip 60. The second folding lines 55' in the embodiment shown are angled. If the second folding lines were curved, the cushion-shaped carton would be barrel-shaped seen in its longitudinal direction, i.e. the elevation of FIG. 4*b*.

The lamp 20 of FIG. 5*a*, *b* has a glass lamp vessel 21, for example, made of glass with an $SiO_2$ content of at least 96% by weight, such as quartz glass, fixed in a lamp cap 22. Light-emitting sections 23 of a biplanar incandescent body are arranged in two planes (compare FIG. 5*a* with 5*b*). The incandescent body is mounted in a tungsten frame 24 with glass transverse rods 25.

In the box of FIG. 1, the lamps are each enclosed in a bag 61 (FIG. 5*b*) with an excess length 62 which is folded back onto itself. The materials 1, 32, 42, 50, 61 around the lamps 20 may be of an identical kind. Favourable are, for example, a box 1 and anterior walls 32, 42 of mini-corrugated cardboard, cushion-shaped cartons 50 of duplex cardboard, and paper bags 61. All these materials are based on cellulose fiber.

The alternative lamp 70 of FIG. 5*c* is a high-pressure gas discharge lamp comprising a glass lamp vessel 71 in a lamp cap 72. A quartz glass discharge vessel 73 is arranged in the lamp vessel between internal current conductors 74, 75. Electrodes 76 are present in an ionizable gas, for example, rare gas, mercury and metal halide. Alternatively, however, the discharge vessel may be made of ceramic material, for example, of aluminium oxide and have a filling of sodium and rare gas.

In FIG. 6, parts corresponding to parts of FIG. 1 have reference numerals which are 100 higher than in FIG. 1.

A partition wall 142', 132' is present in the base 102 between the first 103 and the second side wall 104, with second seats 141' facing towards the first side wall 103 and first seats 131' facing towards the second side wall 104 in this partition wall. The partition wall 142', 132' is double-walled with a first wall portion 142' and a second wall portion 132' which are connected to respective anterior walls 132 and 142 by means of respective connection strips 136.

If the partition wall is also divided, the body 132, 136, 142' in FIG. 6 is identical to the interconnected anterior walls of FIG. 2*b*. The unit 142, 136, 132' only deviates therefrom in that an inwardly folded tag 149 is present which is capable of guiding the closing flap 111 of the lid 108 to between the anterior wall 142 and the side wall 104.

The width of the box is doubled compared with the box 1 of FIG. 1, and its stability in the position drawn is increased thereby. Given an equal capacity to that of the box 1 of FIG. 1, the box 101 of FIG. 6 can have half the height drawn and thus have a substantially square opening. If so desired, the box may be dimensioned so as to have additional partition walls.

I claim:

1. Packed electric lamps comprising a box (1) provided with a base (2) having a base wall (7) and side walls (3, 4, 5, 6) connected thereto and to one another, and provided with a lid (8), first seats (31 ) and in line therewith second seats (41 ) being present in the base (2) at a first wall (3) and a second wall (4), respectively, of said walls, and electric lamps (20) enclosed each at a distance from others in a respective first (31) and a respective second seat (41), characterized in that the lamps (20) are enclosed in cushion-shaped cartons (50) having a longitudinal direction (51), the first seats (31) and the second seats (41) are present at a first side wall (3) and a second side wall (4) which face one another and run substantially parallel to the longitudinal direction (51) of the cushion-shaped cartons (50), which cartons (50) are each accommodated in a first seat (31) and in a second seat (41) in line therewith.

2. Packed electric lamps as claimed in claim 1, characterized in that the first side wall (3) and the second side wall (4) each have an anterior wall (32, 42) in which the seats (31, 41) are present.

3. Packed electric lamps as claimed in claim 2, characterized in that the anterior walls (32, 42) each have a fold (38, 48) bent about parallel folding lines (33, 43), in which fold windows (34, 44) are cut out serving as seats (31, 41).

4. Packed electric lamps as claimed in claim 3, characterized in that the anterior walls (32, 42) are interconnected along connecting folding lines (35, 45) by a connection strip (36).

5. Packed electric lamps as claimed in claim 4, characterized in that the connection strip (36) extends along the base wall (7).

6. Packed electric lamps as claimed in claim 1, characterized in that a partition wall (142', 132') is present in the base (102) between the first (103) and the second side wall (104), in which partition wall second seats (141') facing toward the first side wall (103) and first seats (131') facing toward the second side wall (104) are present.

7. Packed electric lamps as claimed in claim 6, characterized in that the partition wall (142', 132') is double-walled, with a first wall portion (142') and a second wall portion (132') which are each connected to a respective anterior wall (132, 142) via a respective connection strip (136).

8. Packed electric lamps as claimed in claim 1, characterized in that the lid (8) is a flap at a side wall (3).

9. Packed electric lamps as claimed in claim 1, characterized in that the lamps are each enclosed in a bag (61) with an excess longitudinal dimension (62) which is folded back onto itself.

10. Packed electric lamps as claimed in claim 1, characterized in that the materials (1, 32, 42, 50, 61, 132', 142') surrounding the lamps (20) are of the same kind.

* * * * *